US011412330B2

(12) United States Patent
Ko et al.

(10) Patent No.: US 11,412,330 B2
(45) Date of Patent: Aug. 9, 2022

(54) SPEAKER UNIT FOR EARPHONE AND EARPHONE INCLUDING THE SAME

(71) Applicant: ALMUS Corp., Chungcheongnam-do (KR)

(72) Inventors: Ju Heon Ko, Gyeonggi-do (KR); Jong Won Lee, Incheon (KR); Byung Il Min, Gyeonggi-do (KR); Yun Uk Ha, Incheon (KR); Jeong Kwon Park, Gyeonggi-do (KR)

(73) Assignee: Almus Corp., Chungcheongnam-Do (KR)

( * ) Notice: Subject to any disclaimer, the term of this patent is extended or adjusted under 35 U.S.C. 154(b) by 13 days.

(21) Appl. No.: 17/172,326

(22) Filed: Feb. 10, 2021

(65) Prior Publication Data

US 2022/0150641 A1 May 12, 2022

(30) Foreign Application Priority Data

Nov. 12, 2020 (KR) ..... 10-2020-0151072

(51) Int. Cl.
*H04R 1/24* (2006.01)
*H04R 9/06* (2006.01)
(Continued)

(52) U.S. Cl.
CPC ..... *H04R 9/06* (2013.01); *H04R 1/02* (2013.01); *H04R 1/10* (2013.01); *H04R 1/28* (2013.01); *H04R 1/345* (2013.01); *H04R 9/025* (2013.01)

(58) Field of Classification Search
CPC ..... H04R 1/24; H04R 1/26; H04R 1/1075; H04R 9/063; H04R 2209/026
See application file for complete search history.

(56) References Cited

U.S. PATENT DOCUMENTS 7,106,878 B2 * 9/2006 Saiki ..... H04R 25/00 381/396
8,077,898 B2 * 12/2011 Huang ..... H04R 1/1016 381/345
(Continued)

FOREIGN PATENT DOCUMENTS

CN 215268701 U * 12/2021 ..... H04R 1/023
KR 10-2002-0004791 A 1/2002
(Continued)

OTHER PUBLICATIONS

Office Action from corresponding Korean Patent Application No. 10-2020-0151072, dated Oct. 25, 2021.

*Primary Examiner* — Ryan Robinson
(74) *Attorney, Agent, or Firm* — Harness, Dickey & Pierce, P.L.C.

(57) ABSTRACT

A speaker unit for an earphone is provided. The speaker unit for an earphone includes a frame including a first hole in a front thereof and a second hole in a rear thereof; a yoke disposed on the frame and elongated along a front-to-rear direction; a first magnet disposed on one side of the yoke; a first plate disposed on one side of the first magnet; a first diaphragm disposed on one side of the first plate; a second magnet disposed on the other side of the yoke; a second plate disposed on the other side of the second magnet; and a second diaphragm disposed on the other side of the second plate, wherein the first magnet and the second magnet are together in contact with the yoke, and the yoke includes a first passage that connects the first hole and the second hole.

15 Claims, 16 Drawing Sheets

(51) Int. Cl.

| | |
|---|---|
| ***H04R 1/28*** | (2006.01) |
| ***H04R 9/02*** | (2006.01) |
| ***H04R 1/10*** | (2006.01) |
| ***H04R 1/02*** | (2006.01) |
| ***H04R 1/34*** | (2006.01) |

(56) References Cited

U.S. PATENT DOCUMENTS

| | | | | |
|---|---|---|---|---|
| 8,774,447 | B2 * | 7/2014 | Ko | H04R 9/06 381/396 |
| 10,631,096 | B1 * | 4/2020 | Selva | H04R 9/06 |
| 2013/0011000 | A1 * | 1/2013 | Xi | H04R 9/025 381/412 |
| 2015/0350757 | A1 * | 12/2015 | Yang | H04R 1/02 181/199 |
| 2021/0105556 | A1 * | 4/2021 | Solis | H04R 1/2811 |

FOREIGN PATENT DOCUMENTS

| | | | | | |
|---|---|---|---|---|---|
| KR | 10-2002-0015633 | A | | 2/2002 | |
| KR | 200332992 | Y1 | * | 11/2003 | |
| KR | 20040062387 | A | * | 7/2004 | |
| KR | 20060002538 | A | * | 1/2006 | |
| KR | 20020060012 | A | * | 7/2016 | |
| KR | 10-2017-0098527 | A | | 8/2017 | |
| KR | 10-1958257 | B1 | | 7/2019 | |
| WO | WO-2018038516 | A1 | * | 3/2018 | H04R 1/24 |

* cited by examiner

SPEAKER UNIT FOR EARPHONE AND EARPHONE INCLUDING THE SAME

CROSS-REFERENCE TO RELATED APPLICATION(S)

This application claims the benefit under 35 USC § 119(a) of Korean Patent Application No. 10-2020-0151072, filed on Nov. 12, 2020, in the Korean Intellectual Property Office, the entire disclosure of which is incorporated herein by reference for all purposes.

FIELD

The following description relates to a speaker unit for an earphone and an earphone including the same.

BACKGROUND

An earphone includes, inside a housing, a speaker unit that generates sound waves. Also, the earphone may include the housing that includes a nozzle to which an ear tip is coupled.

An example of an earphone including a nozzle is disclosed in Korean Laid-Open Patent Publication No. 10-2017-0098527 (published on Aug. 30, 2017, hereinafter referred to as the present document). In the present document, a speaker unit is included in a housing that includes a nozzle. The earphone disclosed in the present document is designed to emit the front and rear of the speaker unit.

However, such an earphone requires large space inside, which results in an increase in size. In particular, when an additional structure is necessary in order to implement air pressure equalization, there is a problem in that the size of the earphone increases.

PRIOR ART DOCUMENT

Patent Document (Patent Document 0001) Korean Laid-Open Patent Publication No. 10-2017-0098527 (published on Aug. 30, 2017)

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

An object of the present invention is to provide a speaker unit for an earphone and an earphone including the same, which can reduce the size while implementing air pressure equalization.

The object to be achieved by the present invention are not limited to the foregoing objective, and additional objectives, which are not mentioned herein, will be readily understood by those skilled in the art from the following description.

In one general aspect, there is provided a speaker unit for an earphone including a frame including a first hole in the front thereof and a second hole in the rear; a yoke disposed on the frame and elongated along a front-to-rear direction; a first magnet disposed on one side of the yoke; a first plate disposed on one side of the first magnet; a first diaphragm disposed on one side of the first plate; a first coil fixed to the first diaphragm; a second magnet disposed on the other side of the yoke; a second plate disposed on the other side of the second magnet; a second diaphragm disposed on the other side of the second plate; and a second coil fixed to the second diaphragm, wherein the first magnet and the second magnet are together in contact with the yoke, and the yoke includes a first passage that connects the first hole and the second hole.

Preferably, the first passage may include a first-a passage, a first-b passage, and a first-c passage, the first-a passage may be connected to the first hole, the first-b passage may be connected to the second hole, and the first-c passage may be formed by a plurality of passages branched from the first-a passage and joined to the first-b passage.

Preferably, the first magnet or the second magnet may be in contact with a region between the plurality of first-c passages in a region of the yoke.

Preferably, the frame may further include a third hole and a fourth hole, the first hole and the second hole may be arranged to be aligned in a front-to-rear direction, the third hole and the fourth hole may be arranged to be aligned in a direction different from the front-to-rear direction, and the passage may connect the first hole and the third hole and connect the first hole and the fourth hole.

Preferably, the passage may further include a first-d passage and a first-e passage, the first-d passage may be branched from one of the plurality of first-c passages and communicate with the third hole, and the first-e passage may be branched from the other of the plurality of first-c passages and communicate with the fourth hole.

Preferably, the first-a passage may be formed such that a cross-sectional area thereof increases in a direction toward the first hole.

Preferably, the yoke may include a first surface in contact with the first magnet and a second surface disposed on a side opposite to the first surface and in contact with the second magnet, and the first-a passage and the first-b passage may be grooves disposed concavely on the second surface.

Preferably, the yoke may include a second passage, and the second passage may be disposed concavely on the first surface to correspond to the first passage and communicate with an internal space of the first coil.

Preferably, the yoke may include a first surface in contact with the first magnet and a second surface disposed on a side opposite to the first surface and in contact with the second magnet, the first-b passage and the first-c passage may be grooves disposed concavely on the second surface, and the first-a passage may be a hole formed to penetrate through the first surface and the second surface.

Preferably, the yoke may include a first surface in contact with the first magnet and a second surface disposed on a side opposite to the first surface and in contact with the second magnet, and the first-c passage may be disposed in a region of the second surface which is not in contact with the second magnet.

Preferably, the first-b passage and the first-c passage may be disposed to overlap the second magnet.

Preferably, the frame may have a hexahedral shape, the first hole and the second hole may be disposed facing each other, and the third hole and the fourth hole may be disposed facing each other.

In another general aspect, there is provided an earphone including a housing including a nozzle and a speaker unit disposed inside the housing, wherein the speaker unit includes a frame including a first hole in the front thereof and a second hole in the rear; a yoke disposed on the frame and elongated along a front-to-rear direction; a first magnet disposed on one side of the yoke; a first plate disposed on one side of the first magnet; a first diaphragm disposed on one side of the first plate; a first coil fixed to the first diaphragm; a second magnet disposed on the other side of the yoke; a second plate disposed on the other side of the second magnet; a second diaphragm disposed on the other side of the second plate; and a second coil fixed to the second diaphragm, the first magnet and the second magnet are together in contact with the yoke, the yoke includes a first passage that connects the first hole and the second hole, and a vibration direction of the first diaphragm and a vibration direction of the second diaphragm are different from a direction of the nozzle.

Preferably, the vibration direction of the first diaphragm and the vibration direction of the second vibration plate may be perpendicular to the direction of the nozzle.

Preferably, the nozzle and the first hole may be aligned and arranged.

Other features and aspects will be apparent from the following detailed description, the drawings, and the claims.

Figure 1:
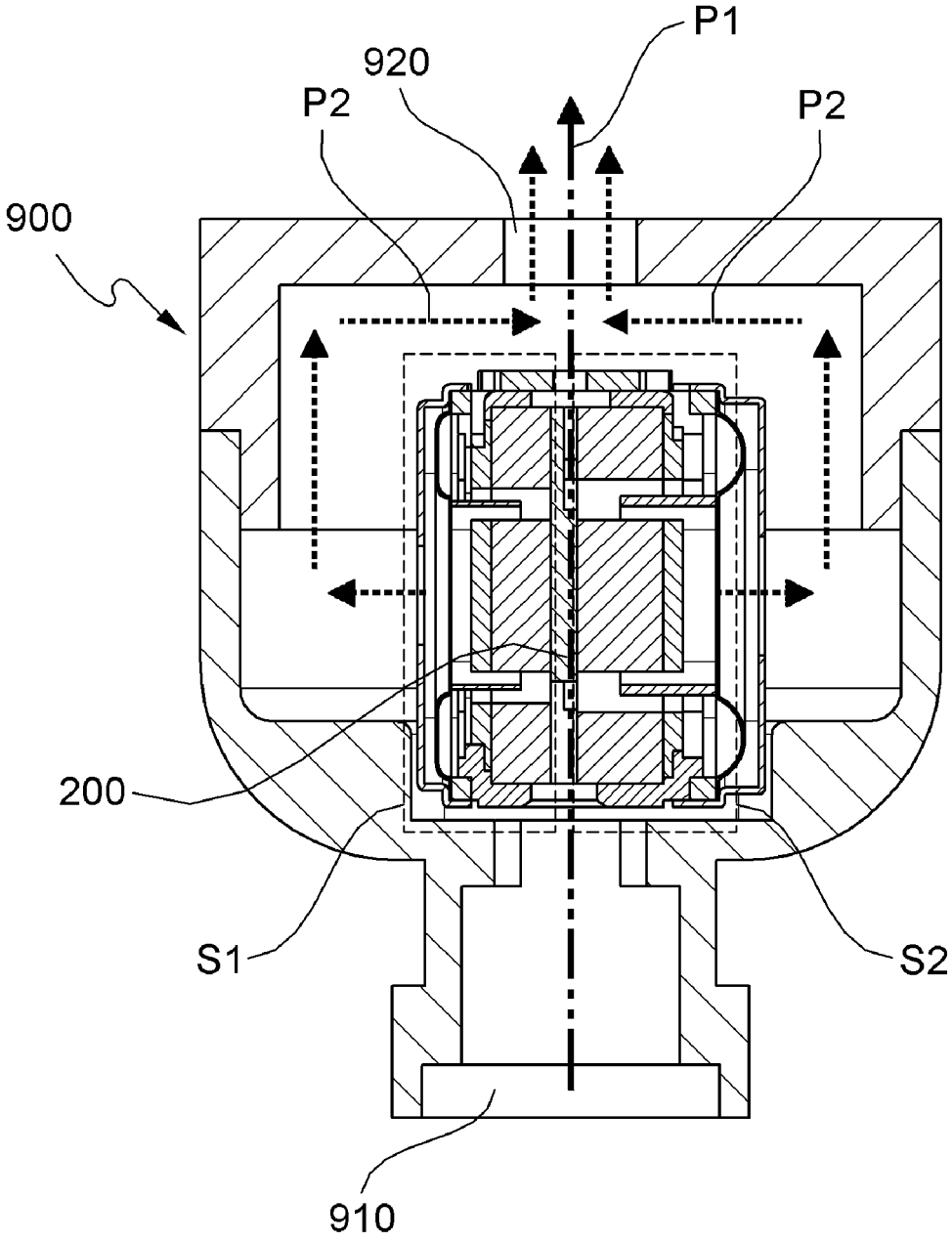
FIG. 1 is a cross-sectional view of an earphone including a speaker unit according to an embodiment.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The objects, features and advantages of the present invention will be more clearly understood from the following detailed description and preferred embodiments taken in conjunction with the accompanying drawings. In the present specification, reference now should be made to the drawings, in which the same reference numerals are used throughout the different drawings to designate the same or similar components. Further, in the description of the present invention, if detailed descriptions of related well-known constructions or functions are determined to make the gist of the present invention unclear, the detailed descriptions will be omitted.

Hereinafter, an earphone including a speaker unit according to an embodiment will be described in detail with reference to the accompanying drawings.

FIG. 1 is a cross-sectional view of an earphone including a speaker unit according to an embodiment.

Hereinafter, the term "front" refers to a direction toward a nozzle 910 of a housing 900, and "rear" refers to a direction opposite to the front direction.

Referring to FIG. 1, the speaker unit according to an embodiment may be divided into a first speaker portion S1 and a second speaker portion S2. The first speaker portion S1 and the second speaker portion S2 are positioned inside the housing 900. The housing 900 includes a nozzle 910 with an ear tip mounted in front thereof. Also, the housing 900 includes a hole 920 at the rear. The first speaker portion S1 and the second speaker portion S2 respectively convert electrical signals into sound waves, which are audio signals. The first speaker portion S1 may emit sound in the middle-high frequency range. Meanwhile, the second speaker portion S2 may emit sound in the middle-low frequency range.

The first speaker portion S1 and the second speaker portion S2 share a yoke 200. The yoke 200 is elongated along the front-to-rear direction. The first speaker portion S1 is disposed on one side of the yoke 200 and the second speaker portion S2 is disposed on the other side of the yoke 200.

In the earphone according to an embodiment, a path P1 for air pressure equalization is formed from the nozzle 910 toward the hole 920 by using the yoke 200. In addition, the first speaker portion S1 and the second speaker portion S2 form a path P2 through which sound or air for tuning of tone or sound characteristics through the hole to the side. The side space between the first speaker portion S1 and the housing 900 and the side space between the second speaker portion S2 and the housing 900 are formed to be wide, which can be used as paths for emitting tuned sound.

Such a characteristic is achieved by aligning the first speaker portion S1 and the second speaker portion S2 in a direction perpendicular to the front-and-rear direction, not in the front-and-rear direction, i.e., arranging them in the up-and-down direction. Each of the first speaker portion S1 and the second speaker portion S1 is arranged in the up-and-down direction, and thus sufficiently internal space can be secured while reducing the size of the earphone. In addition, the first speaker portion S1 for emitting sound in the high frequency range and the second speaker portion s2 for emitting sound in the low frequency range have advantage of implementing tuning structures, respectively, without an additional configuration.

A specific configuration of the speaker unit according to the embodiment is described below.

Figure 2:
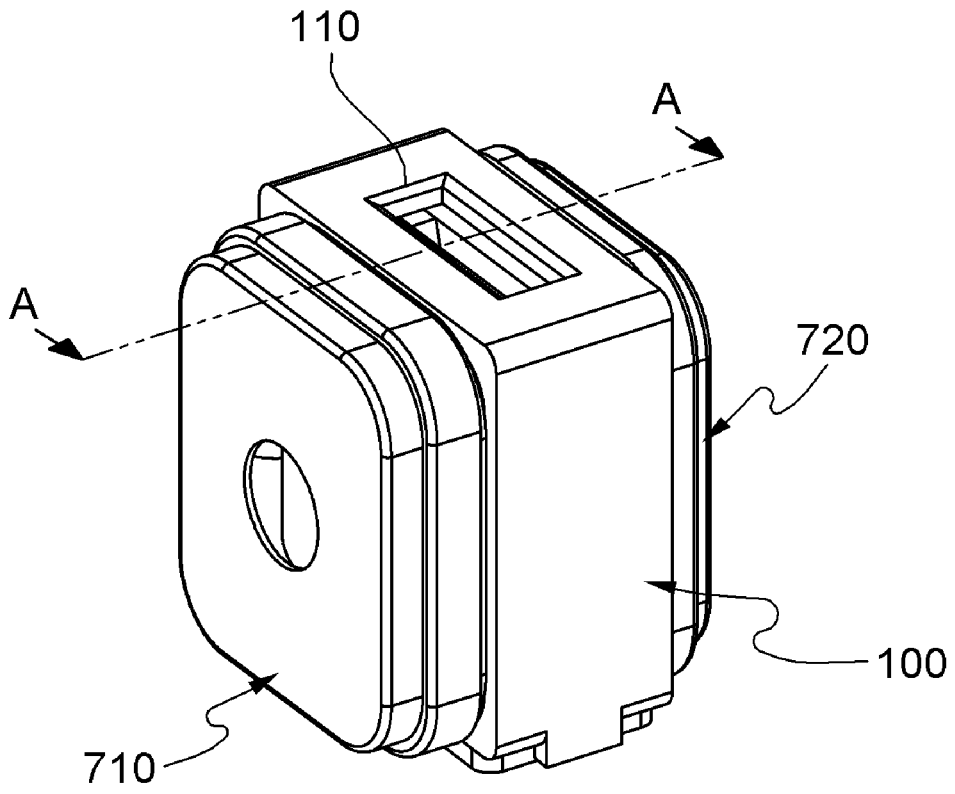
FIG. 2 is a perspective view of a speaker unit.
Figure 3:
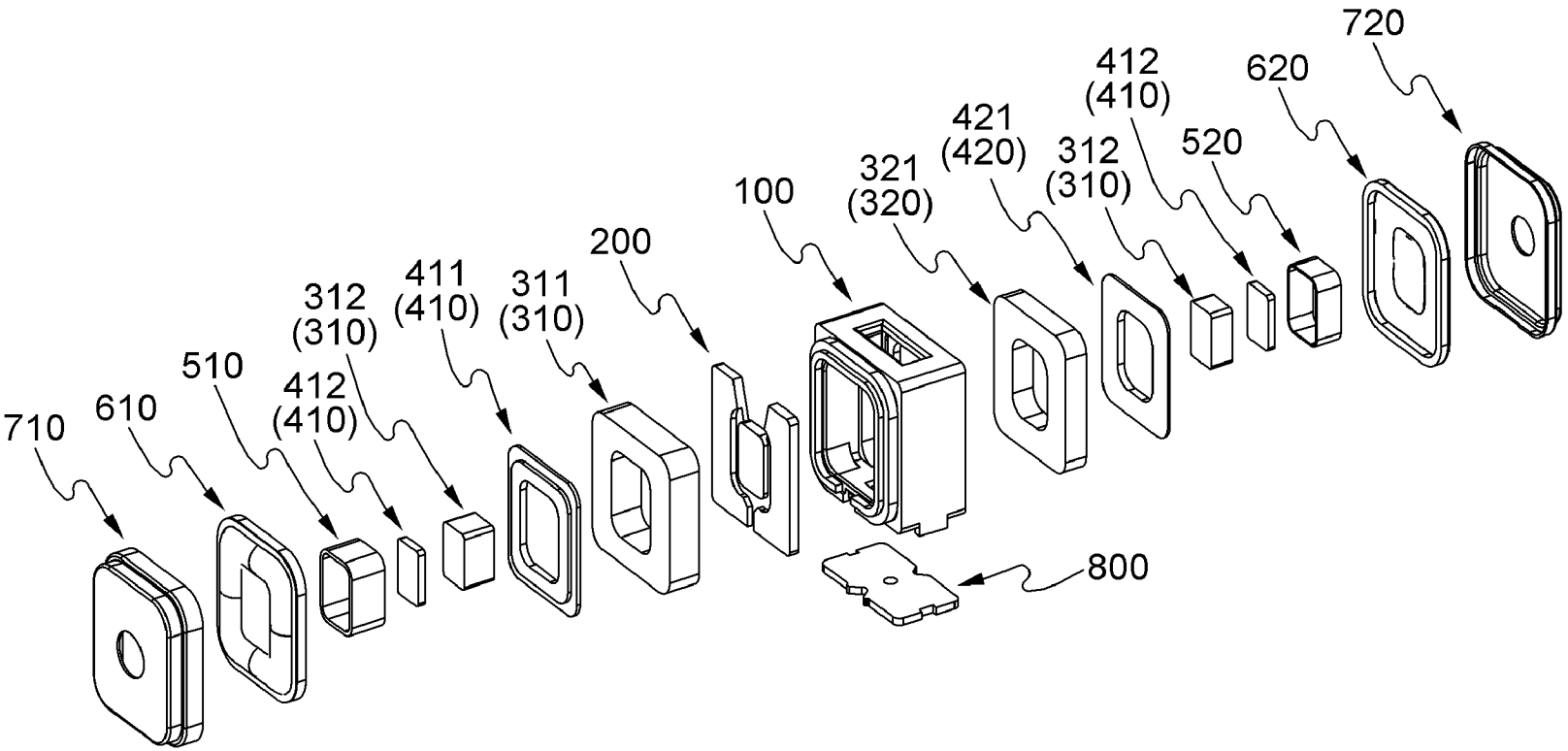
FIG. 3 is an exploded view of the speaker unit.
Figure 4:
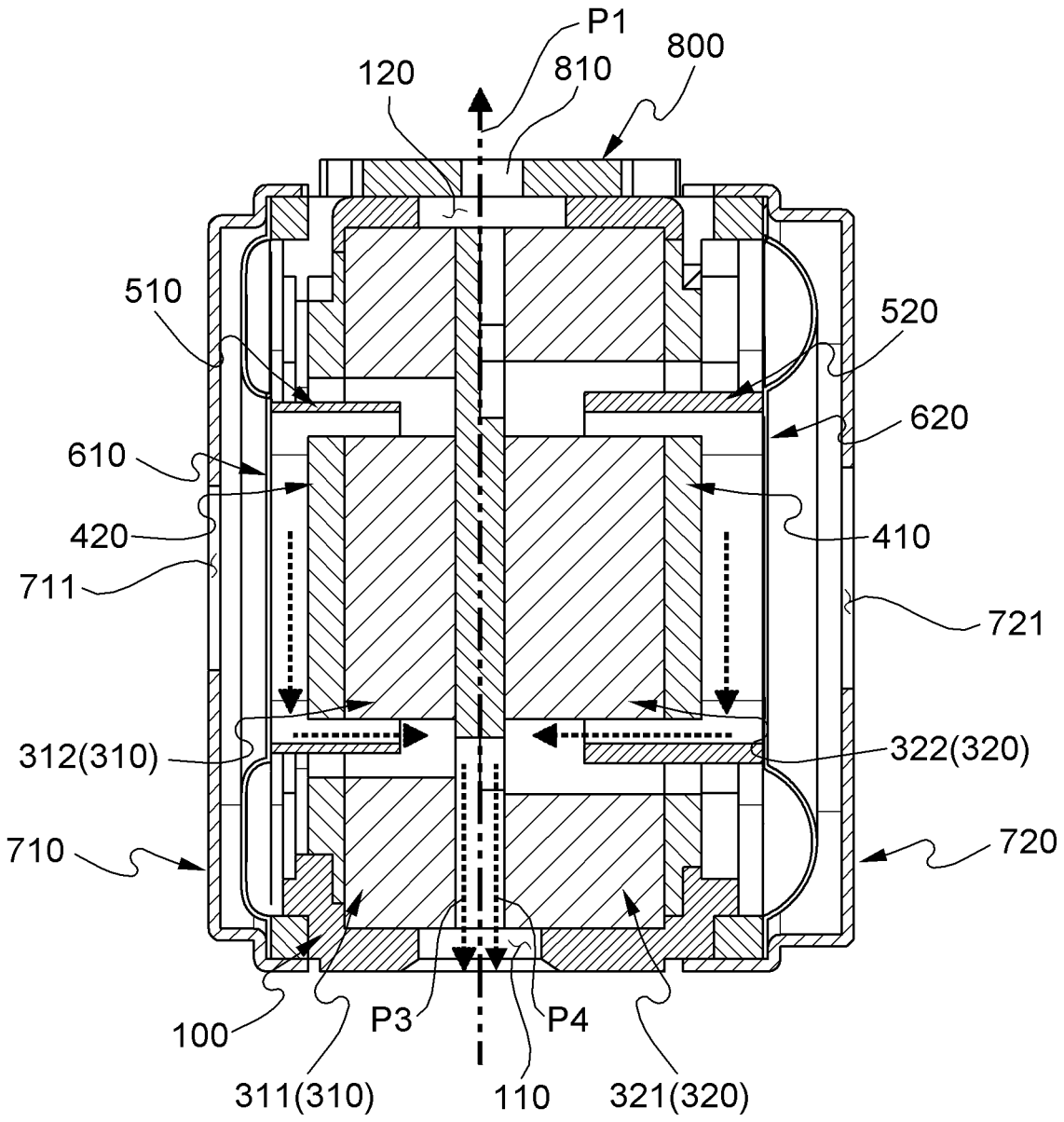
FIG. 4 is a side cross-sectional view of the speaker unit.

FIG. 2 is a perspective view of a speaker unit, FIG. 3 is an exploded view of the speaker unit, and FIG. 4 is a side cross-sectional view of the speaker unit.

Referring to FIGS. 2 to 4, the first speaker portion S1 and the second speaker portion S2 are each disposed in a frame 100. In addition, the first speaker portion S1 and the second speaker portion S2 share a yoke 200 and a substrate 800.

The first speaker portion S1 may include a first magnet 310, a first plate 410, a first coil 510, a first diaphragm 610, and a first grill 710.

The first magnet 310 may include a first-a magnet 311 and a first-b magnet 312. The first-a magnet 311 may be disposed outside the first coil 510 and electromagnetically interact with the first coil 510. The first-b magnet 312 may be disposed inside the first coil 510 and electromagnetically interact with the first coil 510. The first-a magnet 311 may have a rectangular ring shape. The first-b magnet 312 may have a hexahedral shape.

The first plate 410 is brought into contact with the first magnet 310 so that a magnetic field is created. The first plate 410 may include a first-a plate 411 and a first-b plate 412. The first-a plate 411 may be in contact with one surface of the first-a magnet 311. The first-a plate 411 may have a rectangular ring shape. The first-b plate 412 may be in contact with one surface of the first-b magnet 312. The first-b plate 412 may have a rectangular shape.

The first coil 510 may be disposed between the first-a magnet 311 and the first-b magnet 312 in the front-to-rear direction. Also, the first coil 510 may be disposed between the first-a plate 411 and the first-b plate 412 in the front-to-rear direction. The first coil 510 may be disposed such that a portion thereof overlaps the first magnet 310 and the first plate 410 in the front-to-rear direction.

The first diaphragm 610 may be disposed outside the first plate 410 and fixed to the frame 100. The first coil 510 is fixed to the first diaphragm 610. A vibration direction of the first diaphragm 610 may be perpendicular to the front-to-rear direction.

The first grill 710 is disposed outside the first diaphragm 610. The first grill 710 may be fixed to the frame 100. The first grill 710 may include a fifth hole 711. The fifth hole 711 is provided to tune the sound emitted to the side of the frame 100.

The second speaker portion S2 may include a second magnet 320, a second plate 420, a second coil 520, and a second grill 720.

The second first magnet 320 may include a second-a magnet 321 and a second-b magnet 322. The second-a magnet 321 may be disposed outside the second coil 520 and electromagnetically interact with the second coil 520. The second-b magnet 322 may be disposed inside the second coil 520 and electromagnetically interact with the second coil 520. The second-a magnet 321 may have a rectangular ring shape. The second-b magnet 322 may have a hexahedral shape.

The second plate 420 is brought into contact with the second magnet 320 so that a magnetic field is created. The second plate 420 may include a second-a plate 421 and a second-b plate 422. The second-a plate 421 may be in contact with one surface of the second-a magnet 321. The second-a plate 421 may have a rectangular ring shape. The second-b plate 422 may be in contact with one surface of the second-b magnet 322. The second-b plate 422 may have a rectangular shape.

The second coil 520 may be disposed between the second-a magnet 321 and the second-b magnet 322 in the front-to-rear direction. Also, the second coil 520 may be disposed between the second-a plate 421 and the second-b plate 422 in the front-to-rear direction. The first coil 520 may be disposed such that a portion thereof overlaps the second magnet 320 and the second plate 420 in the front-to-rear direction.

The second diaphragm 620 may be disposed outside the second plate 420 and fixed to the frame 100. The second coil 520 is fixed to the second diaphragm 620. A vibration direction of the second diaphragm 620 may be perpendicular to the front-to-rear direction.

The second grill 720 is disposed outside the second diaphragm 620. The second grill 720 may be fixed to the frame 100. The second grill 720 may include a sixth hole 721. The sixth hole 721 is provided to tune the sound emitted to the side of the frame 100.

The yoke 200 is in contact with each of the first magnet 310 and the second magnet 320 to form a magnetic field. One side of the yoke 200 is in contact with the first magnet 310 and the other side of the yoke 200 is in contact with the second magnet 320. The yoke 200 is elongated along the front-to-rear direction to partition the internal space of the frame 100 into sections and each of the first speaker portion S1 and the second speaker portion S2 is disposed in each section.

The substrate 800 may be disposed on the rear surface of the frame 100. The substrate 800 receives an electrical signal from outside and transmits the electrical signal to each of the first coil 510 and the second coil 520.

The frame 100 may have a substantially hexahedral shape.

The magnetic field moves into the space between the first plate 410 and the yoke 200 and the space between the second plate 420 and the yoke 200. When an electric current is applied to the first coil 510 and the second coil 520 and thereby the first coil 510 and the second coil 520 become magnetic, the first coil 510 and the second coil 520 move according to the magnetic polarity of the first coil 510 and the second coil 520.

That is, when the first coil 510 has the same polarity as those of the first plate 410 and the yoke 200, the first coil 510 moves by being pushed by the first plate 410 and the yoke 200. In addition, when the second coil 520 has the same polarity as those of the second plate 420 and the yoke 200, the second coil 520 moves by being pushed away from the second plate 420 and the yoke 200. On the contrary, when the first coil 510 has the opposite polarity to those of the first plate 410 and the yoke 200, the first coil 510 moves by being pulled in the direction of the first plate 410 and the yoke 200. In addition, when the second coil 520 has the opposite polarity to those of the second plate 420 and the yoke 200, the second coil 520 moves by being pulled in the direction of the second plate 420 and the yoke 200. In this way, the first diaphragm 610 and the second diaphragm 620 produce sound by vibrating air while moving.

The sound produced by the first diaphragm 610 and the second diaphragm 620 is emitted to each side of the frame 100, and the sound passes through the fifth hole 711 and the sixth hole 721, and thereby tuned sounds may be emitted through the nozzle 910. The sound in the high frequency range produced by the first diaphragm 610 may be tuned on one side of the frame 100, the sound in the low frequency range produced by the second diaphragm 620 may be tuned on the other side of the frame 100, and the tuned sounds may be emitted together from the nozzle 910. In this case, a tuning portion may be disposed in each of the fifth hole 711 and the sixth hole 721 and may be made of a mesh material. The mesh material may include polyester, nylon, nonwoven fabric, membrane filter, and the like.

The path P1 for air pressure equalization may be formed along the yoke 200. A specific configuration is described below.

Figure 5:
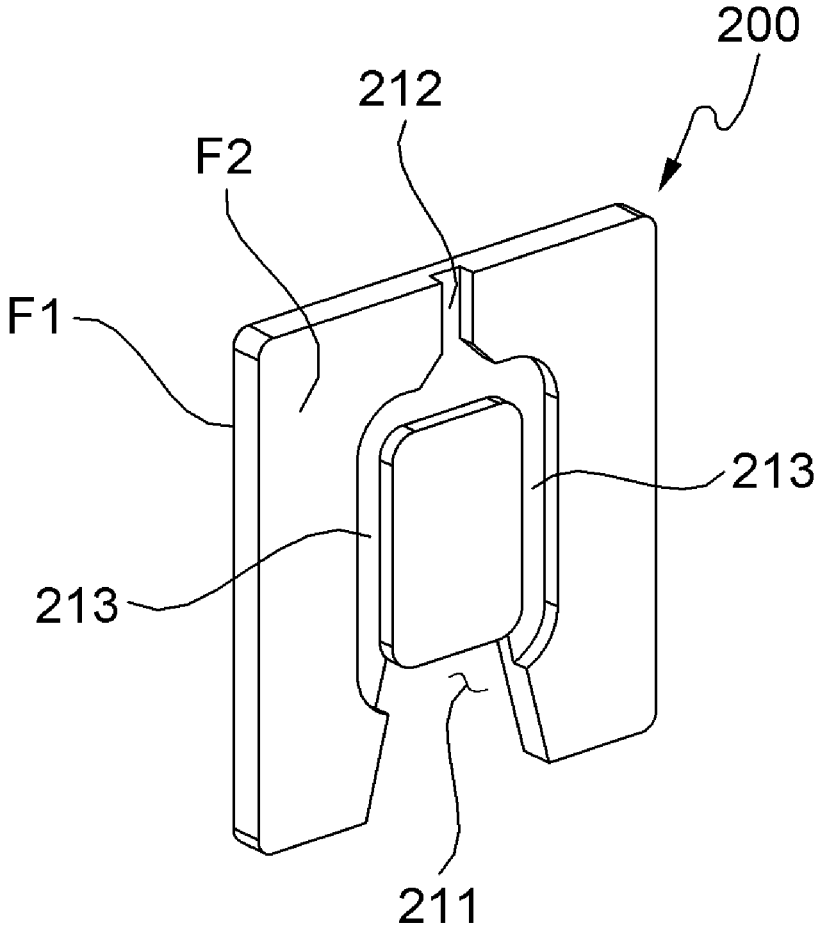
FIG. 5 is a perspective view of a yoke.

FIG. 5 is a perspective view of the yoke 200.

Referring to FIGS. 4 and 5, the yoke 200 may include first passages 211, 212, and 213 that connect the first hole 110 in the front of the frame 100 and the second hole 120 in the rear of the frame 100 to release the pressure of the ear.

The first passages 211, 212, and 213 may include a first-a passage 211, a first-b passage 212, and a first-c passage 213. The first-a passage 211 may be connected to the first hole 110. The first-b passage 212 may be connected to the second hole 120. The first-c passage 213 may connect the first-a passage 211 and the first-b passage 212. The first-c passage 213 may be formed by a plurality of passages branched from the first-a passage 211 and joined to the first-b passage 212. Air may flow from the nozzle 910 of the housing 900 to the second hole 120, sequentially passing through the first hole 110, the first-a passage 211, the first-c passage 213, and the first-b passage 212, and thereby the air pressure equalization may be realized. As described above, the path for air pressure equalization may be formed on the yoke 200 without an additional structure, and thus the internal space of the earphone may be secured while reducing the size of the earphone.

Hereinafter, a surface of the yoke 200 in contact with the first magnet 310 is referred to as a first surface F1 and the surface in contact with the second magnet 320 is referred to as a second surface F2. In this case, the first-b passage 212 and the first-c passage 213 may each be formed concavely on the second surface F2. The first-c passage 213 may be formed by two passages branched from the first-a passage 211. The second-a magnet 321 positioned inside the second coil 520 may be between and in contact with the two passages forming the first-c passage 213. The first-a passage 211 may be implemented in the form of a hole penetrating through the first surface F1 and the second surface F2. Sound in the high frequency range and sound in the low frequency range may be both emitted through the first-a passage 211 provided in the form of a hole.

Figure 6:
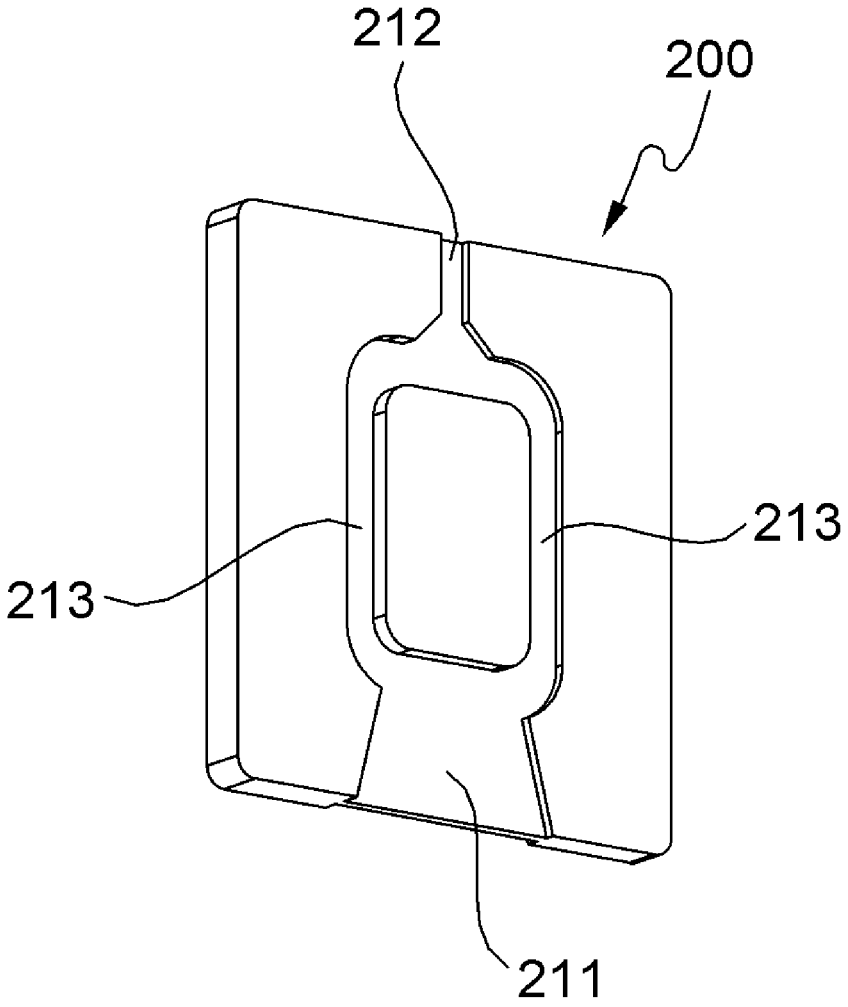
FIG. 6 is a perspective view illustrating a modification of a yoke.
Figure 7:
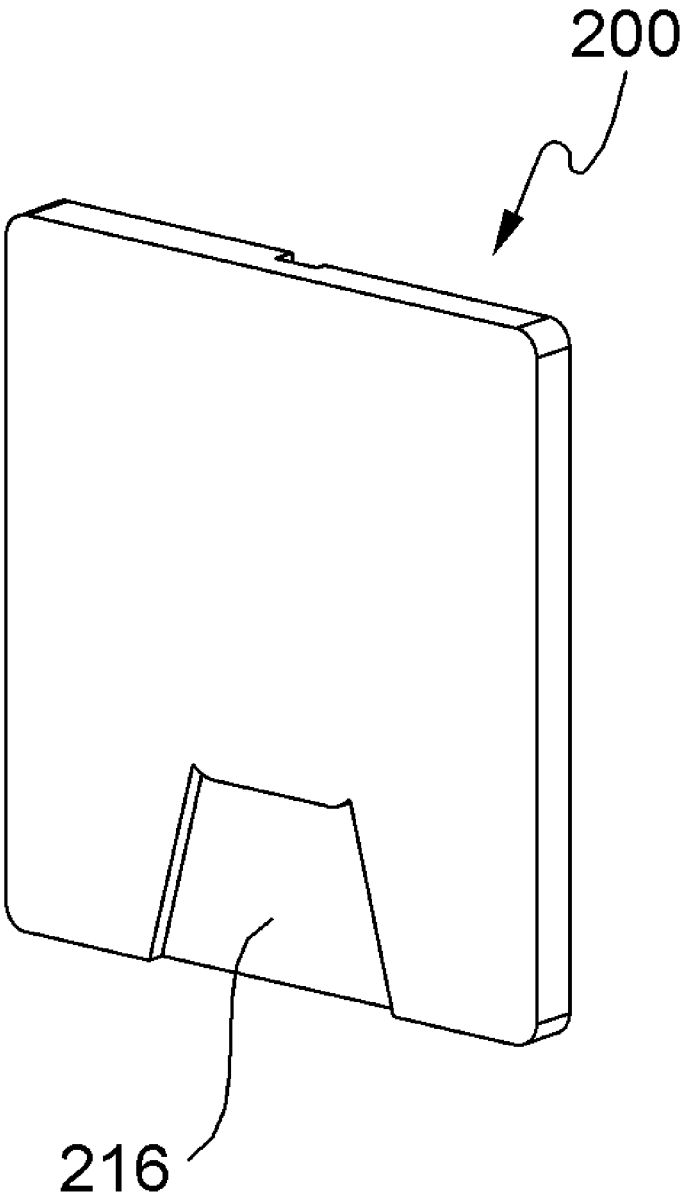
FIG. 7 is a view illustrating a rear side of the yoke shown in FIG. 6.

FIG. 6 is a perspective view illustrating a modification of the yoke 200, and FIG. 7 is a view illustrating a rear side of the yoke 200 shown in FIG. 6.

Referring to FIG. 6, in the modification of the yoke, a first-a passage, a first-b passage 212, and a first-c passage 213 are all formed as grooves disposed on the second surface F2. In addition, a second passage 216 disposed to correspond to the first-a passage 211 may be disposed in the form of a groove on the first surface F1 of the yoke 200. The second passage 216 communicates with the internal space of the first coil 510 to induce the high-frequency sound of the first diaphragm 610 to be emitted toward the nozzle 910.

Figure 8:
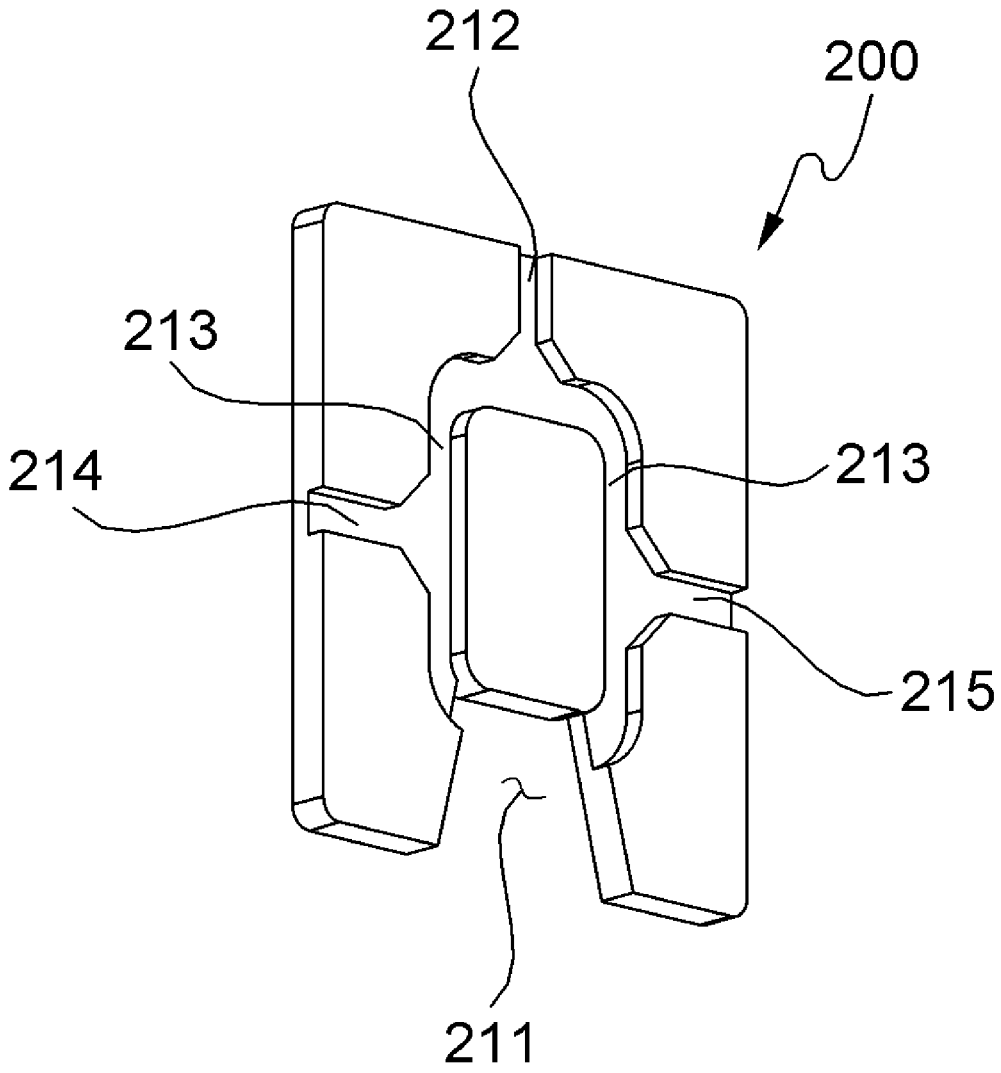
FIG. 8 is a perspective view illustrating another modification of a yoke.

FIG. 8 is a perspective view illustrating another modification of the yoke 200.

Referring to FIG. 8, another modification of the yoke 200 may include a first-d passage 214 and a first-e passage 215, in addition to a first-a passage 211, a first-b passage 212, and a first-c passage 213. The first-b passage 212 and the first-c passage 213 may each be formed concavely on the second surface F2. The first-a passage 211 may be a hole penetrating through the first surface F1 and the second surface F2. The first-d passage 214 may be branched from any one of two first-c passages 213 and be disposed to communicate with a third hole 130 of the frame 100. The first-e passage 215 may be disposed from the other of the two first-c passages 213 and be disposed to communicate with the fourth hole 140 of the frame 100.

Figure 9:
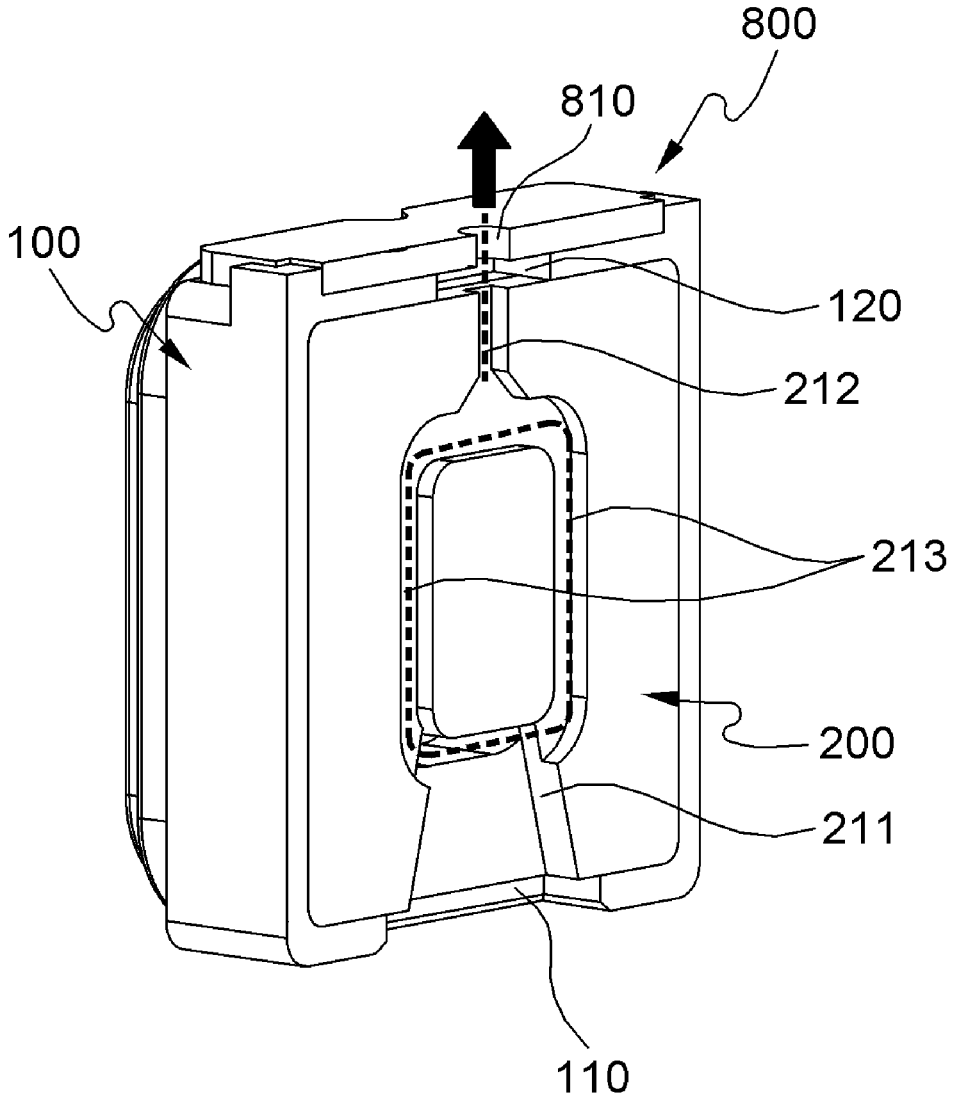
FIG. 9 is a view illustrating a flow of air for air pressure equalization by the yoke shown in FIG. 5.

FIG. 9 is a view illustrating a flow of air for air pressure equalization by the yoke 200 shown in FIG. 5.

Referring to FIG. 9, as air introduced into the first hole 110 of the frame 100 flows into the internal space of the housing 900, passing through the first-a pipe 211, the first-b pipe 212, and the first-c pipe 213 of the yoke 200, the second hole 120, and the hole of the substrate 800, the pressure inside the ear is relieved.

Figure 10:
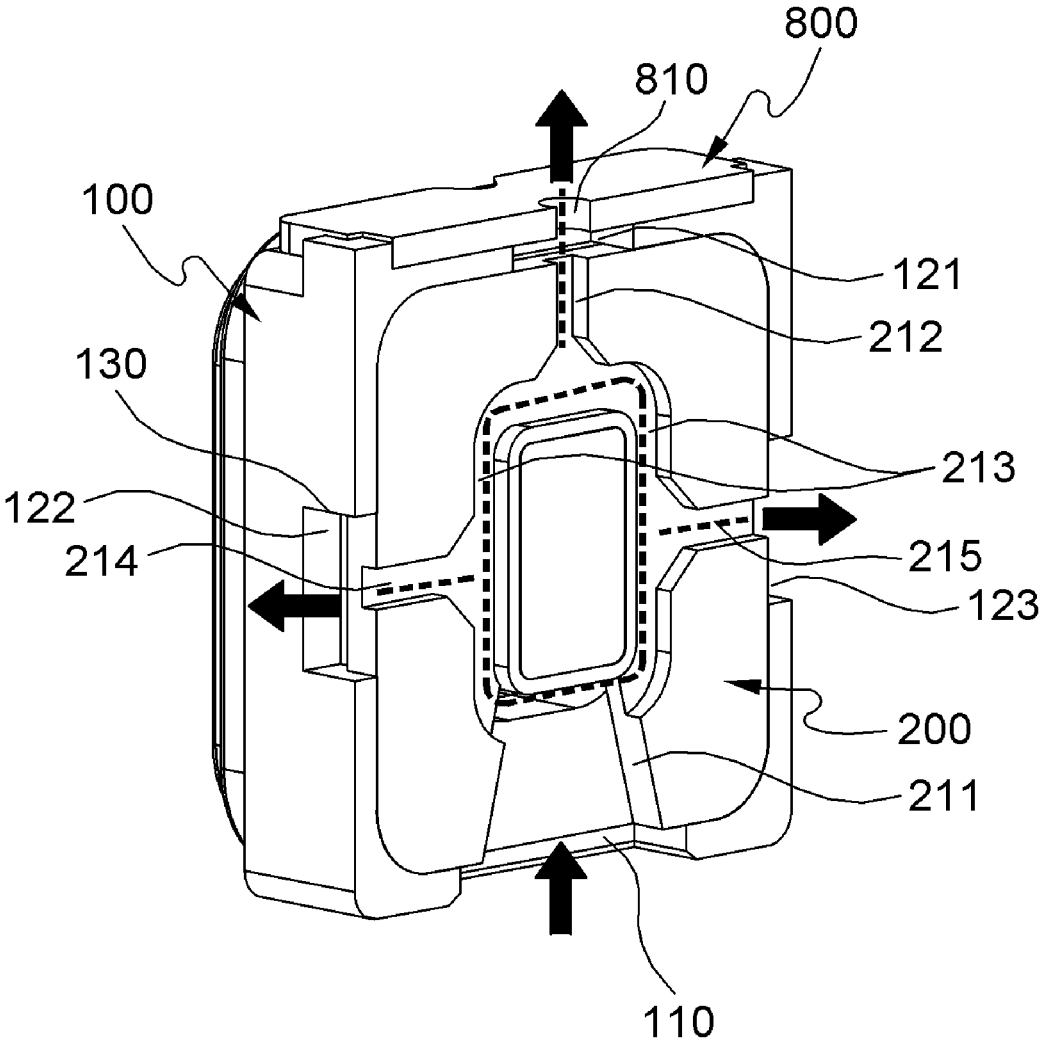
FIG. 10 is a view illustrating a flow of air for air pressure equalization by the yoke shown in FIG. 8.

FIG. 10 is a view illustrating a flow of air for air pressure equalization by the yoke 200 shown in FIG. 8.

Referring to FIG. 10, as air introduced into the first hole 110 of the frame 100 flows into the internal space of the housing 900, passing through the first-a passage 211, the first-b passage 212, and the first-c passage 213 of the yoke 200, the second hole 120, and a hole 810 of the substrate 800, the pressure inside the ear is relieved. In addition, as air introduced into the first hole 110 of the frame 100 flows into the internal space of the housing 900, passing through the first-a passage 211 and the first-d passage 214 of the yoke 200, and the third hole 130, the pressure inside the ear is relieved. In addition, as air introduced into the first hole 110 of the frame 100 flows into the internal space of the housing 900, passing through the first-a passage 211 and the first-e passage 215 of the yoke 200, and the fourth hole 140, the pressure inside the ear is relieved.

Figure 11:
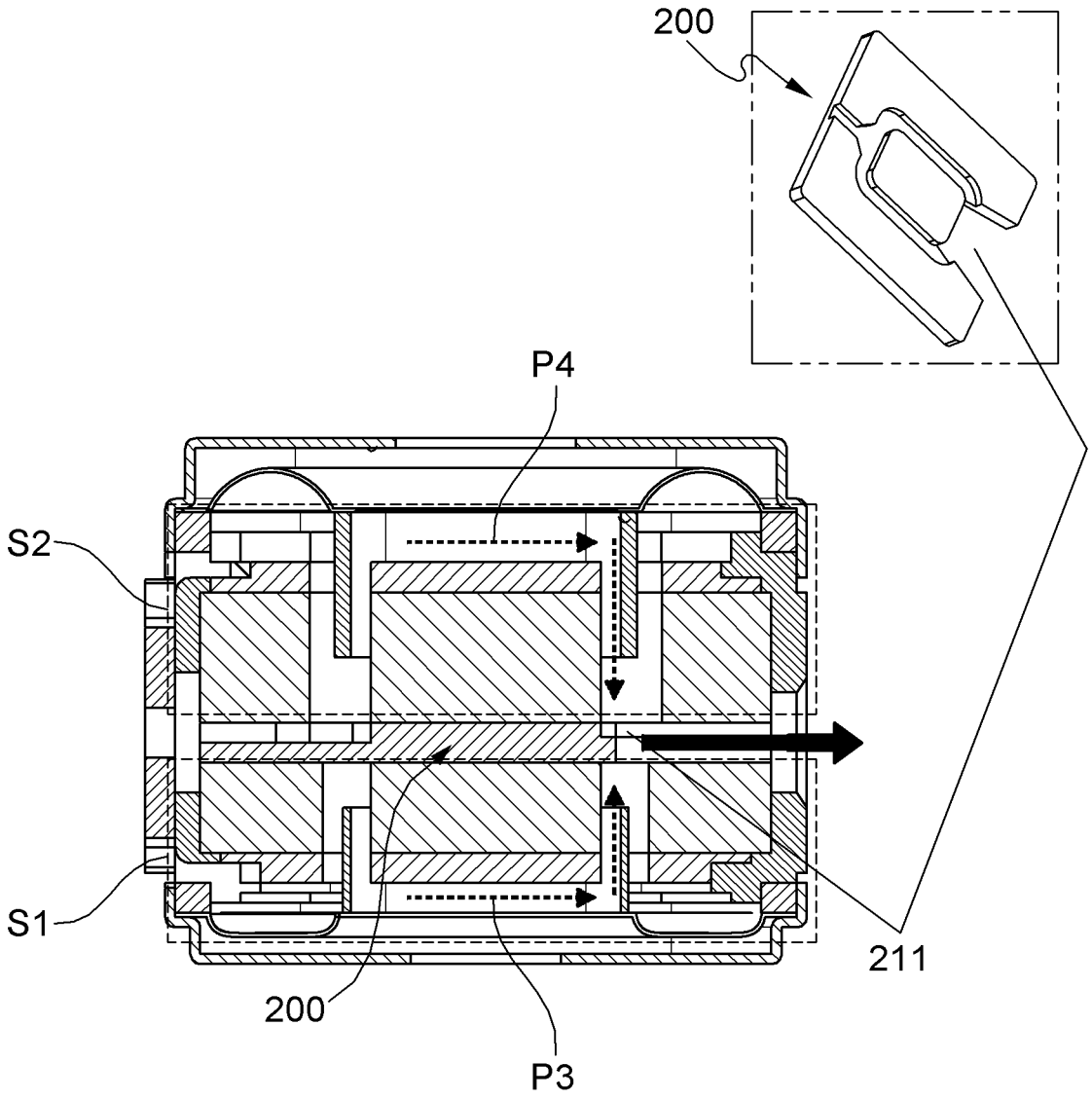
FIG. 11 is a view illustrating a sound emission path of a speaker unit including the yoke shown in FIG. 5.

FIG. 11 is a view illustrating a sound emission path of a speaker unit including the yoke 200 shown in FIG. 5.

Referring to FIG. 11, the high-frequency sound P3 produced by the first diaphragm 610 is introduced into the first-a passage 211 of the yoke 200. In addition, the low-frequency sound P4 produced by the second diaphragm 620 may be introduced into the first-a passage 211 of the yoke 200 and emitted toward the nozzle 910 together with the high-frequency sound.

Figure 12:
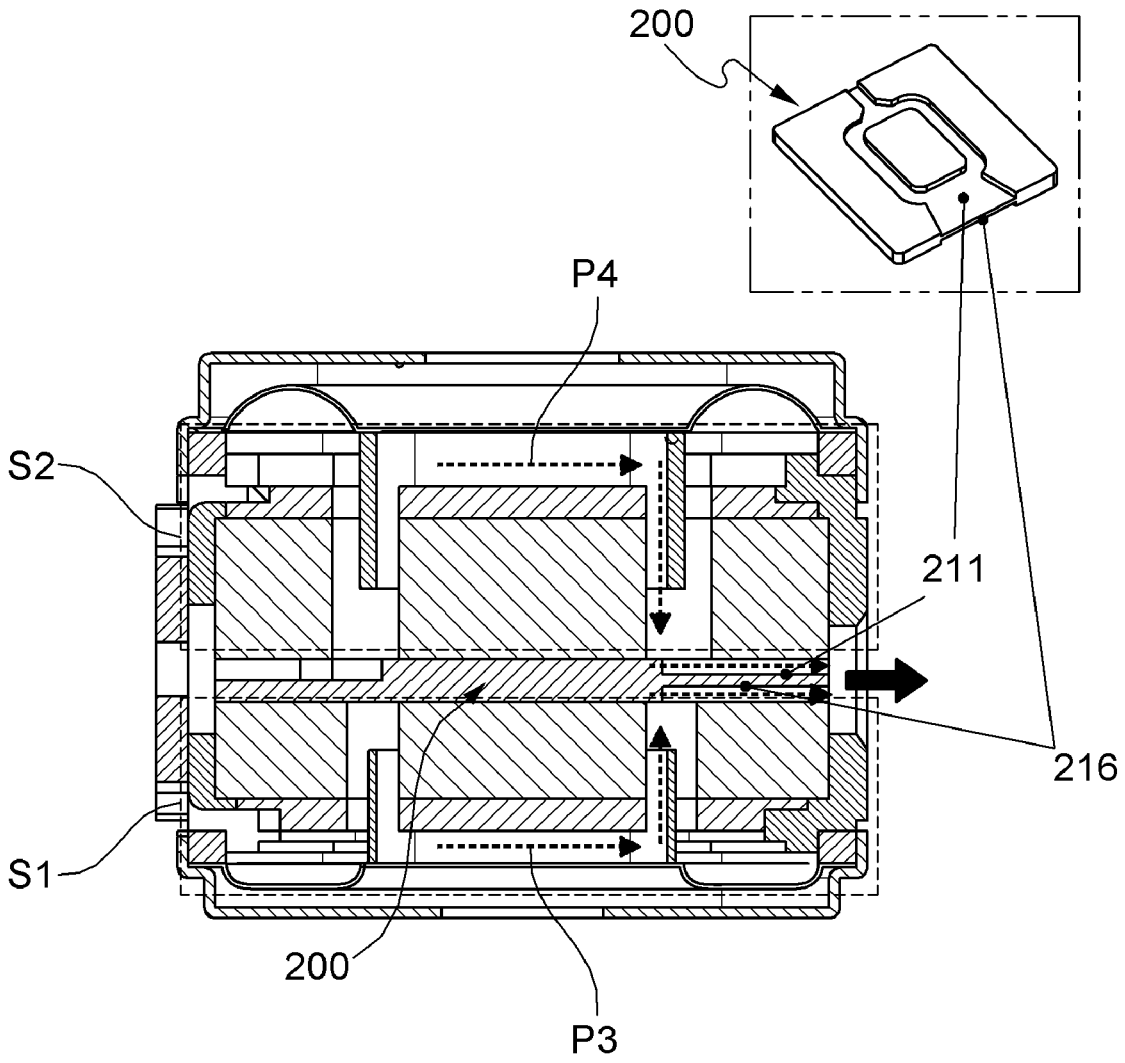
FIG. 12 is a view illustrating a sound emission path of a speaker unit including the yoke shown in FIG. 6.

FIG. 12 is a view illustrating a sound emission path of a speaker unit including the yoke 200 shown in FIG. 6.

Referring to FIG. 12, the high-frequency sound P3 produced by the first diaphragm 610 is introduced into the second passage 216 of the yoke 200. In addition, the low-frequency sound P4 produced by the second diaphragm 620 is introduced into the first-a passage 211 of the yoke 200. The second passage 216 and the first-a passage 211 are divided from each other, the high-frequency sound P3 and the low-frequency sound P4 may separately pass through the first hole 110 of the frame 100.

Figure 13:
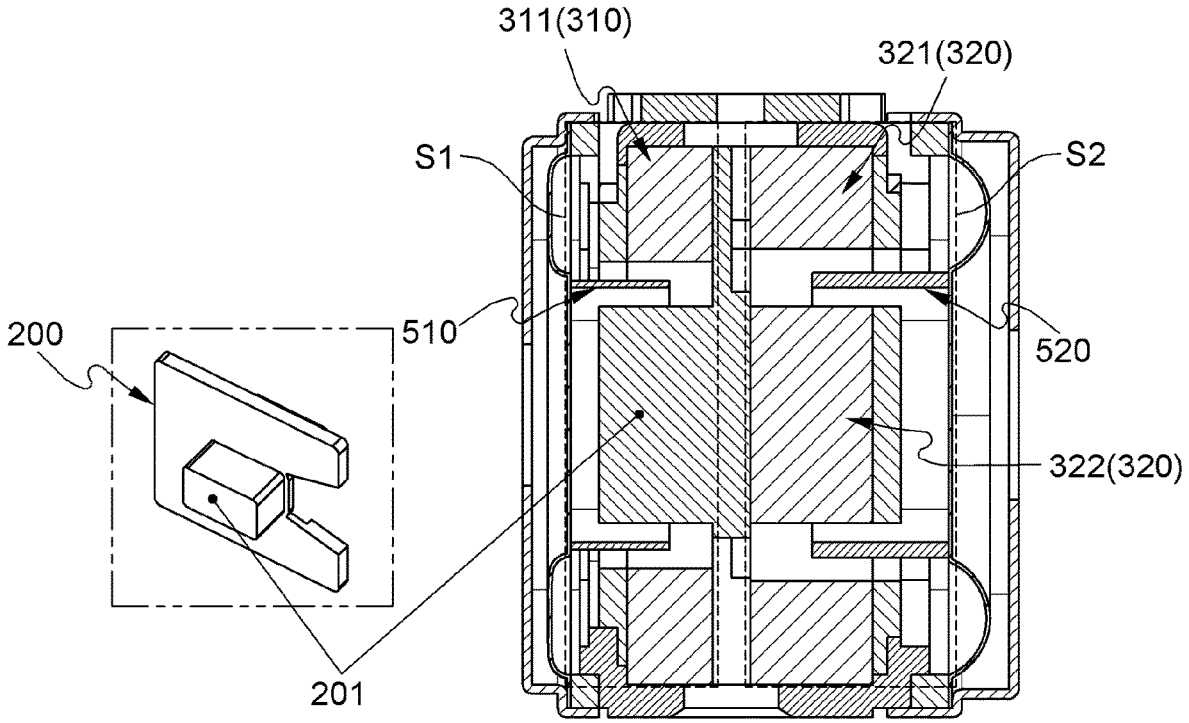
FIG. 13 is a view illustrating a speaker unit according to another embodiment.

FIG. 13 is a view illustrating a speaker unit according to another embodiment.

Referring to FIG. 13, in the speaker unit according to another embodiment, as a first magnet, a first-a magnet 311 may be disposed outside a first coil 510, and a first-b magnet 312 disposed inside the first coil 510 may be omitted. As a second magnet 320, a second-a magnet 321 may be disposed outside a second coil 520 and a second-b magnet 322 may also be disposed inside the second coil 520.

A yoke 200 may include a first protruding portion 201 protruding from a first surface F1. The first protrusion portion 201 may be disposed in the space which is not needed to accommodate the first-b magnet 312 as the first-b magnet 312 is omitted. As the first protruding portion 201 is disposed inside the first coil 510, it is possible to drive a first speaker portion S1 only with the first-a magnet 311 disposed outside the first coil 510.

Figure 14:
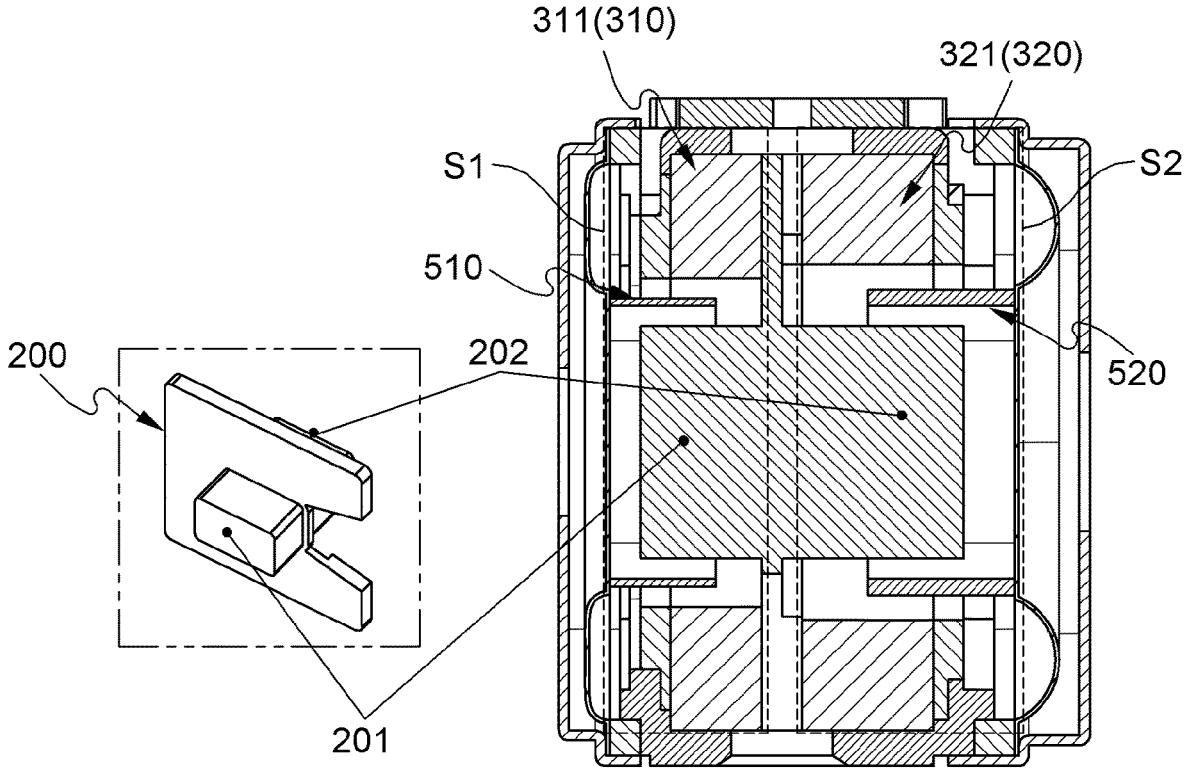
FIG. 14 is a view illustrating a speaker unit according to yet another embodiment.

FIG. 14 is a view illustrating a speaker unit according to still another embodiment.

Referring to FIG. 14, in the speaker unit according to still another embodiment, as a first magnet 310, a first-a magnet 311 may be disposed outside a first coil, and a first-b magnet 312 disposed inside the first coil 510 may be omitted. As a second magnet 320, a second-a magnet 321 may be disposed outside a second coil 520, and a second-b magnet 322 disposed inside the second coil 520 may be omitted.

A yoke 200 may include a first protruding portion 201 protruding from a first surface F1 and a second protruding portion 202 protruding from a second surface F2. The first protrusion portion 201 may be disposed in the space which is not needed to accommodate the first-b magnet 312 as the first-b magnet 312 is omitted. As the first protruding portion 201 is disposed inside the first coil 510, it is possible to drive a first speaker portion S1 only with the first-a magnet 311 disposed outside the first coil 510. The second protruding portion 202 may be disposed in the space which is not needed to accommodate the second-b magnet 322 as the second-b magnet 322 is omitted. As the second protruding portion 202 is disposed inside the second coil 520, it is possible to drive a second speaker portion S2 only with the second-a magnet 321 disposed outside the second coil 520.

Figure 15:
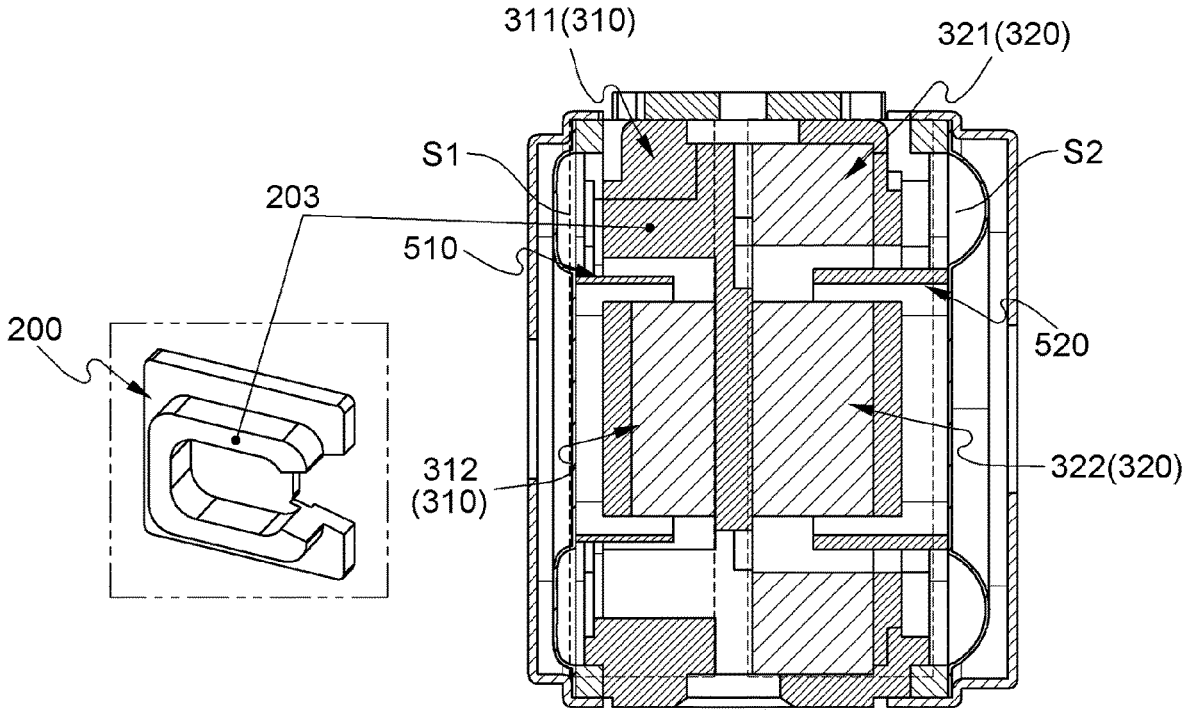
FIG. 15 is a view illustrating a speaker unit according to another embodiment.

FIG. 15 is a view illustrating a speaker unit according to another embodiment.

Referring to FIG. 15, in the speaker unit according to another embodiment, as a first magnet 310, a first-a magnet 311 disposed outside a first coil 510 is omitted and a first-b magnet 312 may be disposed inside the first coil 510. As a second magnet 320, a second-a magnet 321 may be disposed outside a second coil 520 and a second-b magnet 322 may also be disposed inside the second coil 520.

A yoke 200 may include a third protruding portion 203 protruding from a first surface F1. The third protruding portion 203 may be formed in an annular shape. The third protruding portion 203 may be disposed in the space which is not needed to accommodate the first-a magnet 311 as the first-a magnet 311 is omitted. As the third protruding portion 203 is disposed outside the first coil 510, it is possible to drive a first speaker portion S1 only with the first-b magnet 312 disposed inside the first coil 510.

Figure 16:
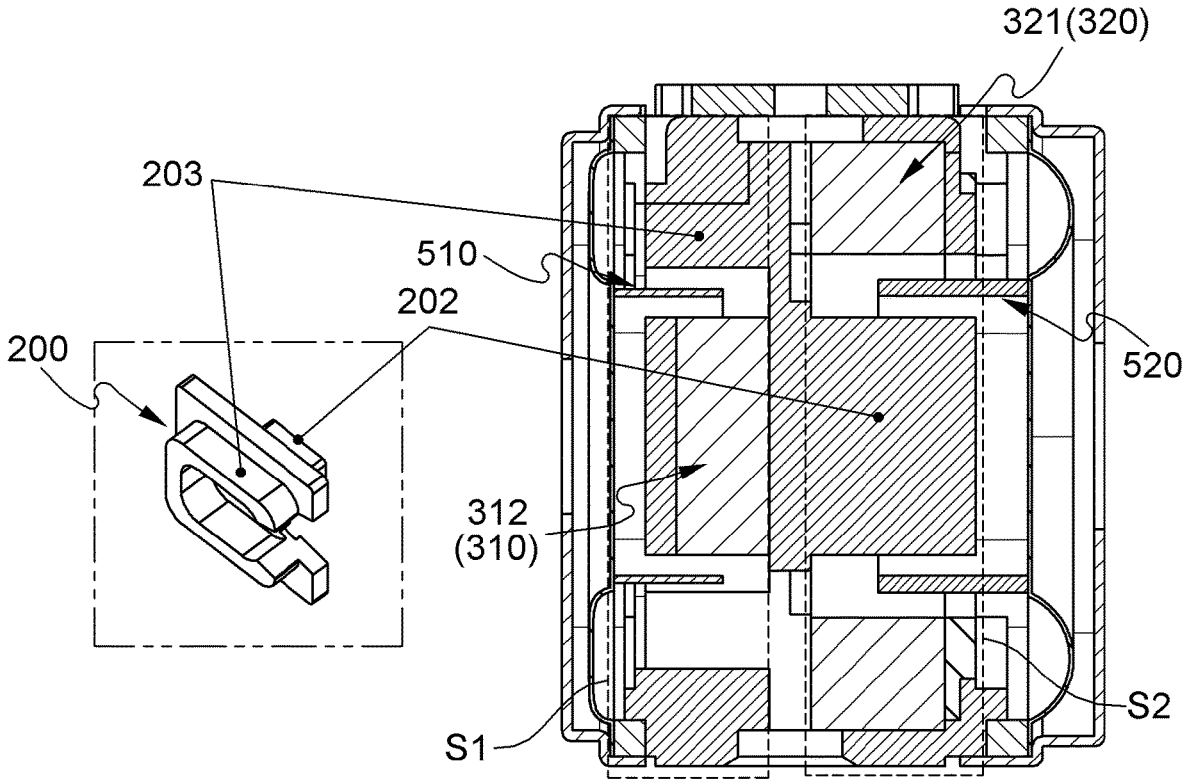
FIG. 16 is a view illustrating a speaker unit according to another embodiment.

FIG. 16 is a view illustrating a speaker unit according to another embodiment.

Referring to FIG. 16, in the speaker unit according to another embodiment, as a first magnet 310, a first-a magnet 311 disposed outside a first coil 510 is omitted and a first-b magnet 312 may be disposed inside the first coil 510. As a second magnet 320, a second-a magnet 321 may be disposed outside a second coil 520 and a second-b magnet 322 disposed inside the second coil 520 may be omitted.

A yoke 200 may include a third protruding portion 203 protruding from a first surface F1. The third protruding portion 203 may be disposed in the space which is not needed to accommodate the first-a magnet 311 as the first-a magnet 311 is omitted. As the third protruding portion 203 is disposed outside the first coil 510, it is possible to drive a first speaker portion S1 only with the first-b magnet 312 disposed inside the first coil 510. The second protruding portion 201 may be disposed in the space which is not needed to accommodate the second-b magnet 322 as the first-b magnet 322 is omitted. As the second protruding portion 201 is disposed inside the second coil 510, it is possible to drive a second speaker portion S2 only with the second-a magnet 321 disposed outside the second coil 520.

According to an embodiment, an advantageous effect of reducing a size of an earphone while realizing air pressure equalization is provided.

According to an embodiment, an advantageous effect of securing sufficient internal space of the earphone while reducing the size of is provided.

According to an embodiment, an advantageous effect of emitting sound to the side of a frame is provided.

According to an embodiment, an advantageous effect of tuning each of low-frequency sound and high-frequency sound and emitting the tuned sound is provided.

According to an embodiment, there is an advantage in that it is possible to tune the sound of the ultra-low frequency range while implementing the air pressure equalization.

According to an embodiment, the space of the first diaphragm and the space of the second diaphragm are separated by the yoke, thereby greatly reducing mutual interference.

Although the preferred embodiments of the speaker unit for an earphone and an earphone including the same have been disclosed for illustrative purposes, those skilled in the art will appreciate that various modifications, additions and substitutions are possible, without departing from the scope and spirit of the invention as disclosed in the accompanying claims. Therefore, it should be noted that such modifications or changes belong to the claims of the present invention.

What is claimed is:

1. A speaker unit for an earphone comprising:
- a frame comprising a first hole in a front thereof and a second hole in a rear thereof;
- a yoke disposed on the frame and elongated along a front-to-rear direction;
- a first magnet disposed on one side of the yoke;
- a first plate disposed on one side of the first magnet;
- a first diaphragm disposed on one side of the first plate;
- a first coil fixed to the first diaphragm;
- a second magnet disposed on the other side of the yoke;
- a second plate disposed on the other side of the second magnet;
- a second diaphragm disposed on the other side of the second plate; and
- a second coil fixed to the second diaphragm,
- wherein the first magnet and the second magnet are together in contact with the yoke, and the yoke comprises a first passage that connects the first hole and the second hole.

2. The speaker unit of claim 1, wherein the first passage comprises a first-a passage, a first-b passage, and a first-c passage, the first-a passage is connected to the first hole, the first-b passage is connected to the second hole, and the first-c passage is formed by a plurality of passages branched from the first-a passage and joined to the first-b passage.

3. The speaker unit of claim 2, wherein the first magnet or the second magnet is in contact with a region between the plurality of first-c passages in a region of the yoke.

4. The speaker unit of claim 2, wherein the frame further comprises a third hole and a fourth hole, the first hole and the second hole are arranged to be aligned in a front-to-rear direction, the third hole and the fourth hole are arranged to be aligned in a direction different from the front-to-rear direction, and the passage connects the first hole and the third hole and connects the first hole and the fourth hole.

5. The speaker unit of claim 4, wherein the passage further comprises a first-d passage and a first-e passage, the first-d passage is branched from one of the plurality of first-c passages and communicates with the third hole, and the first-e passage is branched from the other of the plurality of first-c passages and communicates with the fourth hole.

6. The speaker unit of claim 2, wherein the first-a passage is formed such that a cross-sectional area thereof increases in a direction toward the first hole.

7. The speaker unit of claim 5, wherein the yoke comprises a first surface in contact with the first magnet and a second surface disposed on a side opposite to the first surface and in contact with the second magnet, and the first-a passage and the first-b passage are grooves disposed concavely on the second surface.

8. The speaker unit of claim 7, wherein the yoke comprises a second passage and the second passage is disposed concavely on the first surface to correspond to the first passage and communicates with an internal space of the first coil.

9. The speaker unit of claim 2, wherein the yoke comprises a first surface in contact with the first magnet and a second surface disposed on a side opposite to the first surface and in contact with the second magnet, the first-b passage and the first-c passage are grooves disposed concavely on the second surface, and the first-a passage is a hole formed to penetrate through the first surface and the second surface.

10. The speaker unit of claim 2, wherein the yoke comprises a first surface in contact with the first magnet and a second surface disposed on a side opposite to the first surface and in contact with the second magnet, and the first-c passage is disposed in a region of the second surface which is not in contact with the second magnet.

11. The speaker unit of claim 2, wherein the first-b passage and the first-c passage are disposed to overlap the second magnet.

12. The speaker unit of claim 4, wherein the frame has a hexahedral shape, the first hole and the second hole are disposed facing each other, and the third hole and the fourth hole are disposed facing each other.

13. An earphone comprising:

a housing comprising a nozzle; and a speaker unit disposed inside the housing, wherein the speaker unit comprises a frame comprising a first hole in a front thereof and a second hole in a rear thereof;

a yoke disposed on the frame and elongated along a front-to-rear direction;

a first magnet disposed on one side of the yoke;

a first plate disposed on one side of the first magnet;

a first diaphragm disposed on one side of the first plate;

a first coil fixed to the first diaphragm;

a second magnet disposed on the other side of the yoke;

a second plate disposed on the other side of the second magnet;

a second diaphragm disposed on the other side of the second plate; and a second coil fixed to the second diaphragm, the first magnet and the second magnet are together in contact with the yoke, the yoke comprises a first passage that connects the first hole and the second hole, and a vibration direction of the first diaphragm and a vibration direction of the second diaphragm are different from a direction of the nozzle.

14. The earphone of claim 13, wherein the vibration direction of the first diaphragm and the vibration direction of the second vibration plate are perpendicular to the direction of the nozzle.

15. The earphone of claim 13, wherein the nozzle and the first hole are aligned and arranged.

* * * * *